US008839977B2

(12) United States Patent
Yang

(10) Patent No.: US 8,839,977 B2
(45) Date of Patent: Sep. 23, 2014

(54) STRAP RECEIVABLE WATER KETTLE CAP

(75) Inventor: Shih-Sheng Yang, New Taipei (TW)

(73) Assignee: Universal Trim Supply Co., Ltd., New Taipei (TW)

( * ) Notice: Subject to any disclaimer, the term of this patent is extended or adjusted under 35 U.S.C. 154(b) by 627 days.

(21) Appl. No.: 13/236,591

(22) Filed: Sep. 19, 2011

(65) Prior Publication Data

US 2013/0043264 A1 Feb. 21, 2013

(30) Foreign Application Priority Data

Aug. 18, 2011 (TW) ..... 100215428 U

(51) Int. Cl.

| | |
|---|---|
| ***B65D 55/16*** | (2006.01) |
| ***B65D 25/28*** | (2006.01) |
| ***B65D 25/00*** | (2006.01) |
| ***B65D 25/10*** | (2006.01) |
| ***B65D 53/00*** | (2006.01) |
| ***B65D 81/24*** | (2006.01) |
| ***B65D 23/12*** | (2006.01) |
| ***A45F 3/18*** | (2006.01) |
| ***A45C 13/30*** | (2006.01) |
| ***A45F 5/00*** | (2006.01) |

(52) U.S. Cl.

CPC ..... *A45C 13/30* (2013.01); *A45F 2200/0583* (2013.01); *A45F 3/18* (2013.01); *A45C 2013/303* (2013.01); *A45F 5/00* (2013.01)

USPC ..... 220/375; 220/212.5; 220/744; 220/754; 215/306; 215/395

(58) Field of Classification Search

CPC .. B65D 47/147; B65D 51/242; B65D 23/003; A45C 13/30; A45C 2013/303; A45C 2200/20; A45F 2200/0583; A45F 2003/003; A45F 2005/1013; Y10S 224/926

USPC ..... 220/375, 744, 754, 212.5; 215/306, 215/395; 224/148.6

See application file for complete search history.

(56) References Cited

U.S. PATENT DOCUMENTS

| | | | | | |
|---|---|---|---|---|---|
| 2,793,901 | A | * | 5/1957 | Johnson | 294/31.2 |
| 3,924,786 | A | * | 12/1975 | Duquette | 224/251 |
| 4,253,488 | A | * | 3/1981 | Leverberg | 137/382 |
| 5,413,261 | A | * | 5/1995 | Wu | 224/148.4 |
| 5,462,185 | A | * | 10/1995 | Walker, III | 215/307 |

* cited by examiner

*Primary Examiner* — Fenn Mathew
*Assistant Examiner* — Andrew T Kirsch
(74) *Attorney, Agent, or Firm* — Leong C. Lei

(57) ABSTRACT

A strap receivable water kettle cap includes a cap coupleable to a water kettle. The cap has a side wall forming an elongate slot and a bottom to which a rotary ring is mounted. The rotary ring has an upper portion forming a diameter reduced vertical wall. The vertical wall and the side wall of the cap form therebetween a receiving space for receiving strap in a winding fashion. The vertical wall forms an extension and retention section, and the strap extends through and is retained by the extension and retention section. The strap further extends through the slot of the side wall of the cap to have end extension sections of the strap projecting outside the cap. The tips of the end extension sections of the strap are processed to form a closed terminal. The strap can be selectively retracted back into the receiving space inside the cap.

12 Claims, 5 Drawing Sheets

STRAP RECEIVABLE WATER KETTLE CAP

TECHNICAL FIELD OF THE INVENTION

The present invention generally relates to a strap receivable water kettle cap, and more particularly to a structure that provides a function of shoulder carrying water kettle and is capable of fast receiving the carrying strap in the kettle cap.

DESCRIPTION OF THE PRIOR ART

A water kettle is easy to carry and allows a user to drink water in any desired time and due to the drive resulting from rising of "green" spirit for environmental protection, people get more frequently carrying a water kettle to contain drinking water when they are going to school and work, do exercises, or even travelling. A conventional water kettle is provided with a carrying strap that allows a user to carry the water kettle with a hand or a shoulder for easy access. However, it is generally impossible for shoulder carrying of water kettle if a user is doing certain activities, such as cycling, mountain climbing, and rock climbing; or in cases where the user wishes to place the water kettle in a side pocket of a backpack, the carrying strap becomes troublesome to the user. Although in some water kettles, the carrying strap is designed to attach to the kettle through releasable buckle, so that the strap, when not being used, can be easily removed from the kettle. However, such designs make the use of the water kettle inconvenient and may also cause undesired loss of the strap, or the strap may be simply left in home and cannot be used when the kettle user gets out. Apparently, the conventional strap of water kettle is not a perfect one and further improvements are needed.

SUMMARY OF THE INVENTION

The primary objective of the present invention is to provide a strap receivable water kettle cap, which allows fast retraction and concealment of a strap that is provided for shoulder carrying through an operation of rotating a rotary ring attached to a cap so as to realize fast retraction and storage and provide easy and practical use.

To achieve the above objective, the present invention provides a strap receivable water kettle cap, which comprises a cap that is coupleable to a water kettle, a rotary ring mounted to a bottom of the cap, and a strap. The cap has a side wall forming an elongate slot. The rotary ring has an upper portion forming a diameter reduced vertical wall. The vertical wall and the side wall of the cap form therebetween a receiving space. The vertical wall forms an extension and retention section, which structurally comprises at least two parallel slits to allow the strap to extend through parallel slits to be retained thereby. The strap is received in the receiving space and extends through the extension and retention section, and further extends through the slot formed in the side wall of the cap to have end extension sections of the strap projecting outside the cap. The end extension sections of the strap are processed to form a closed terminal. As such, a user may use the strap to carry the water kettle on his or her body. When the user does not need to carry the kettle, the rotary ring mounted to the bottom of the cap can be rotated to retract the strap back into and conceal in the receiving space of the cap to thereby realize fast retraction and storage of the strap.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
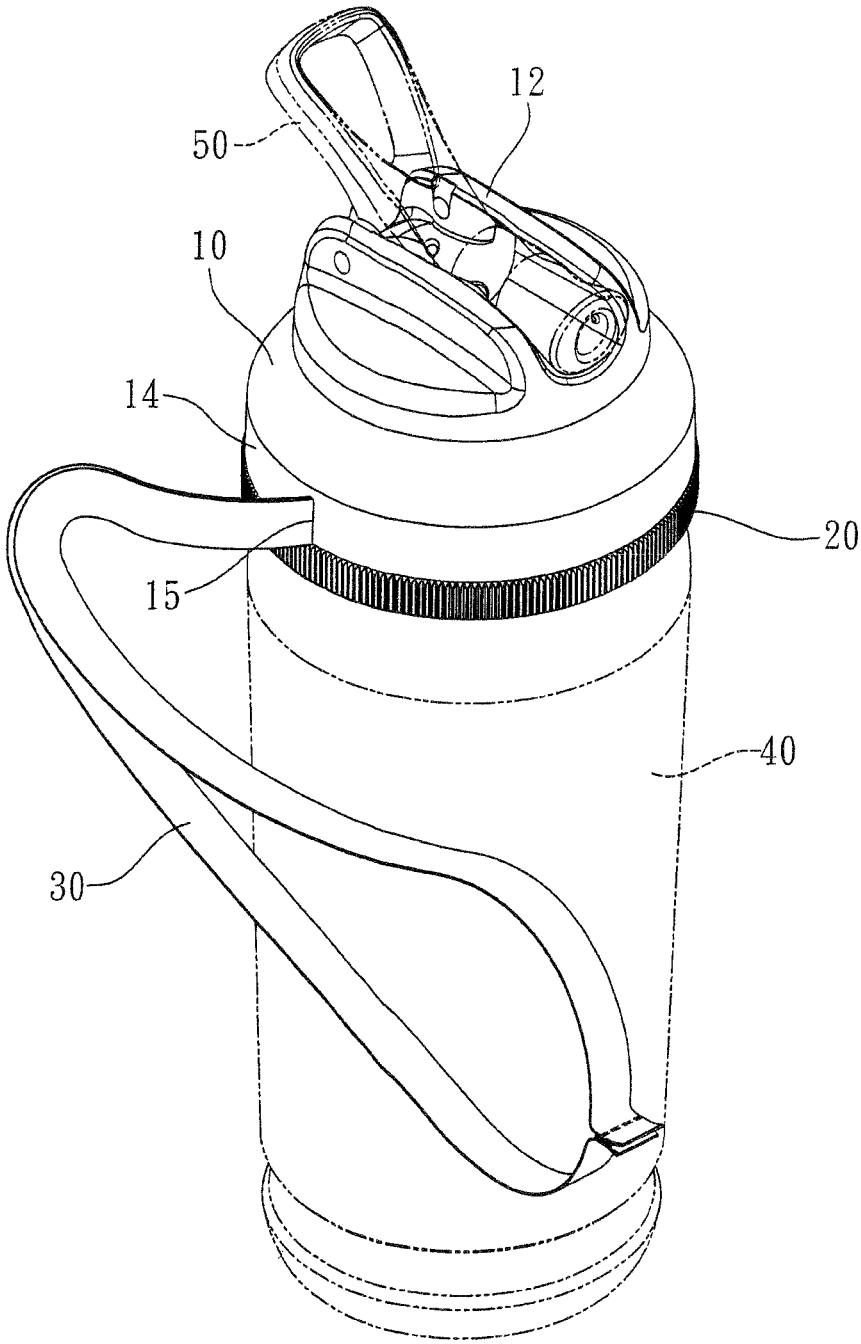
FIG. 1 is a perspective view of the present invention attached to a water kettle.
Figure 2A:
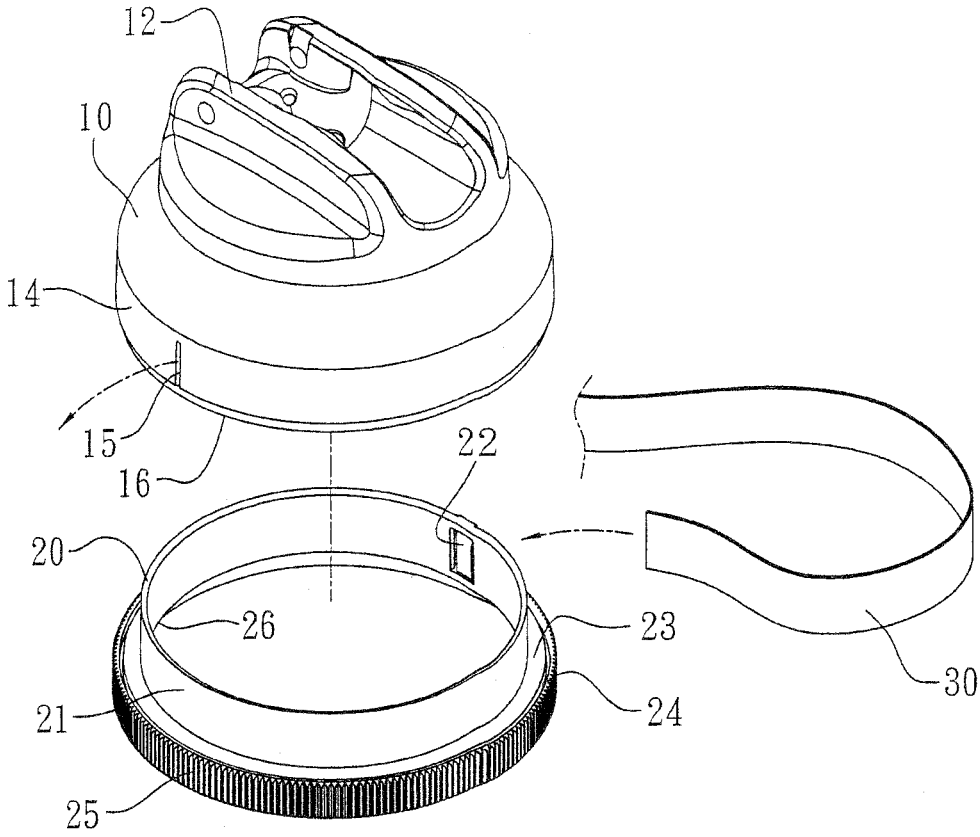
FIG. 2*a* is a bottom side perspective view of a cap of the present invention.
Figure 2:
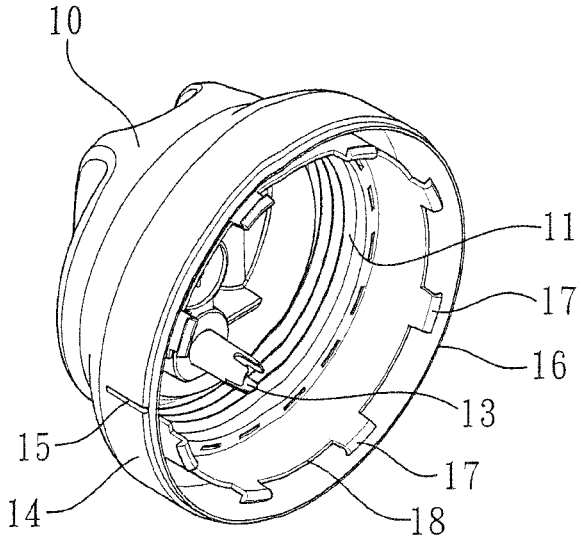
FIG. 2 is an exploded view of the present invention.
Figure 3:
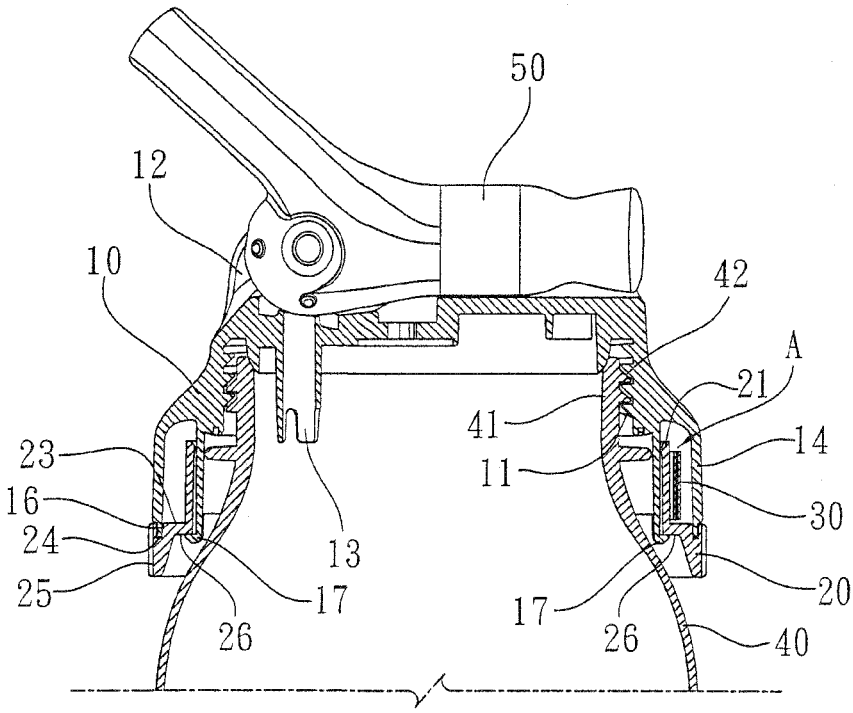
FIG. 3 is a partial cross-sectional view of the present invention.

Referring to FIGS. 1-3, the present invention provides a strap receivable water kettle cap, which generally comprises a cap 10, a rotary ring 20 that is attached to a bottom of the cap 10, and a strap 30.

The cap 10 is attachable to a kettle mouth 41 of a water kettle 40. In the instant embodiment, the cap 10 forms therein an internal thread 11 (see FIG. 2*a*) for direct threading engagement with the water kettle 40 of which the kettle mouth 41 forms a mateable external thread 42. The cap 10 has a top forming a retention seat 12 and the retention seat 12 has a bottom forming a water outlet 13 extending therethrough. The retention seat 12 is structured to receive a suck nozzle 50 to attach thereto in such a way that the suck nozzle 50 has a central hole corresponding to the water outlet 13 to allow a suck of water by a user. The present invention further provides an elongate slot 15 that is formed through a side wall 14 of the cap 10. The cap 10 has a bottom rim forming a raised rib 16. The cap 10 forms coupling means on an inside surface of the side wall 14, whereby the cap 10 is coupleable to the rotary ring 20 with the coupling means. In the embodiment illustrated, the coupling means comprises a plurality of pawls 17, and the cap uses the pawls 17 to engage a coupling seat 26 that is formed on a lower edge of an inside surface of the rotary ring 20. As shown in FIG. 2*a*, in the instant embodiment of the present invention, a connection wall 18 is formed between adjacent ones of the pawls 17 so that the pawls 17 may be reduced in vertical dimension but structurally strengthened.

Further, the connection wall 18 and the side wall 14 may form therebetween a space for accommodating the strap.

In the embodiment illustrated, the rotary ring 20 has an upper portion forming a diameter reduced vertical wall 21, and as shown in the drawings, the vertical wall is made in the form of a circle of circumferential wall. The vertical wall 21 forms therein an extension and retention section 22. In the embodiment illustrated, the extension and retention section 22 comprises two parallel and spaced slits, whereby the strap 30 may be put through the two parallel slits with two ends to be retained thereby. The vertical wall 21 has a lower end where a recessed step 23 is formed. Formed in the step 23 is a groove 24 corresponding to the raised rib 16 of the cap 10, whereby in assembling, the raised rib 16 is fit into the groove 24 and the pawls 17 of the cap 10 are set in engagement with the coupling seat 26 formed on the lower edge of the inside surface of the rotary ring 20 to couple them together (see FIG. 3) in such a way that the cap 10 and the rotary ring 20 are relatively rotatable with respect to each other and the vertical wall 21 of the rotary ring 20 and the side wall 14 of the cap 10 form therebetween a receiving space A (see FIG. 3). The receiving space A formed between the cap 10 and the rotary ring 20 is delimited by the side wall 14 and the vertical wall 21. Alternatively, in other feasible embodiments that are not illustrated herein, the vertical wall 21 may not be set in the form of a full circle or in a closed form and, with the pawls 17 set in engagement with the coupling seat 26 of the cap 10, the pawls 17 and the side wall 14 form therebetween a receiving space A, which may similarly serve as a space for receiving and accommodating the strap 30 therein. Further, the rotary ring 20 has an outer circumference forming a roughened section 25 for easy rotation of the rotary ring 20. Further, the extension and retention section 22 may be alternatively structured to comprise more than two parallel slits, such as three or four slits, and this also allows the strap 30 to sequentially and curvedly extend through all the parallel slits to similarly achieve the result of securing an end of the strap.

In the embodiment illustrated, the vertical wall is set in the form of a full circle of circumferential wall 21 and the vertical wall forms the extension and retention section 22, yet the vertical wall may alternatively be structured as an incomplete circle of circumferential wall and may comprise simply a short segment of vertical wall in which the extension and retention section 22 is formed. Under this arrangement, when the pawls 17 are put in engagement with the coupling seat 26 of the cap 10, the pawls 17 can form a receiving space A with respect to the side wall 14.

Figure 2B:
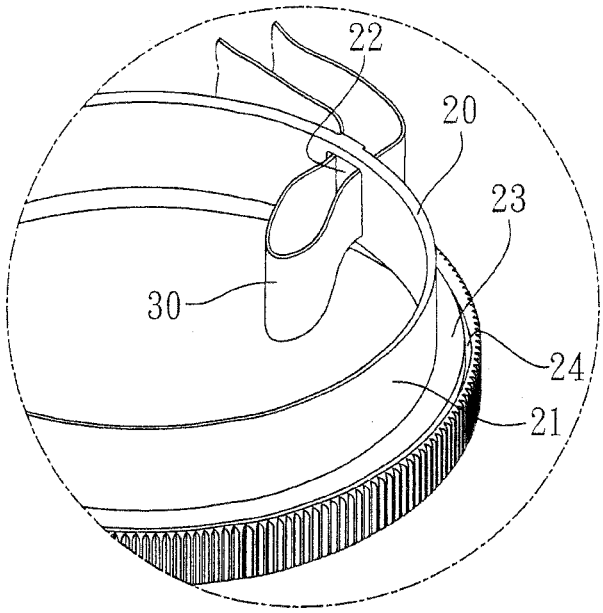
FIG. 2*b* is a partial perspective view illustrating mounting of a strap of the present invention.

The strap 30 is received in the receiving space A defined between the cap 10 and the rotary ring 20 and extends through the slits of the extension and retention section 22 of the rotary ring 20 to have an inner terminal thereof retained thereby (see FIG. 2*b*). The ends of the strap 30 are further put through the slot 15 formed in the side wall 14 of the cap 10 to allow end extension sections of the strap to extend outside the cap 10. In the instant embodiment, tips of the end extension sections of the strap 30 are set outside the cap 10 and are folded over each other and sewn together to form a closed outer terminal, whereby the outer terminal provides a stopping function for the strap 30 for being blocked outside the slot 15 of the cap 10. Further, in other embodiments, the tips of the strap 30 may alternatively be fixed with thermal pressing or bonded to decorative buckling member or pull tab, or female and male buttons respectively provided on ends.

Further, in practical use, the strap 30 can be withdrawn by just a small length to be sufficient to fit over the wrist of a user and may then be securely attached to the wrist by rotating the rotary ring 20 to retract and tighten the strap. This avoids the embarrassing situation that an excessive length of the strap makes it easily gets off the wrist.

Figure 4:
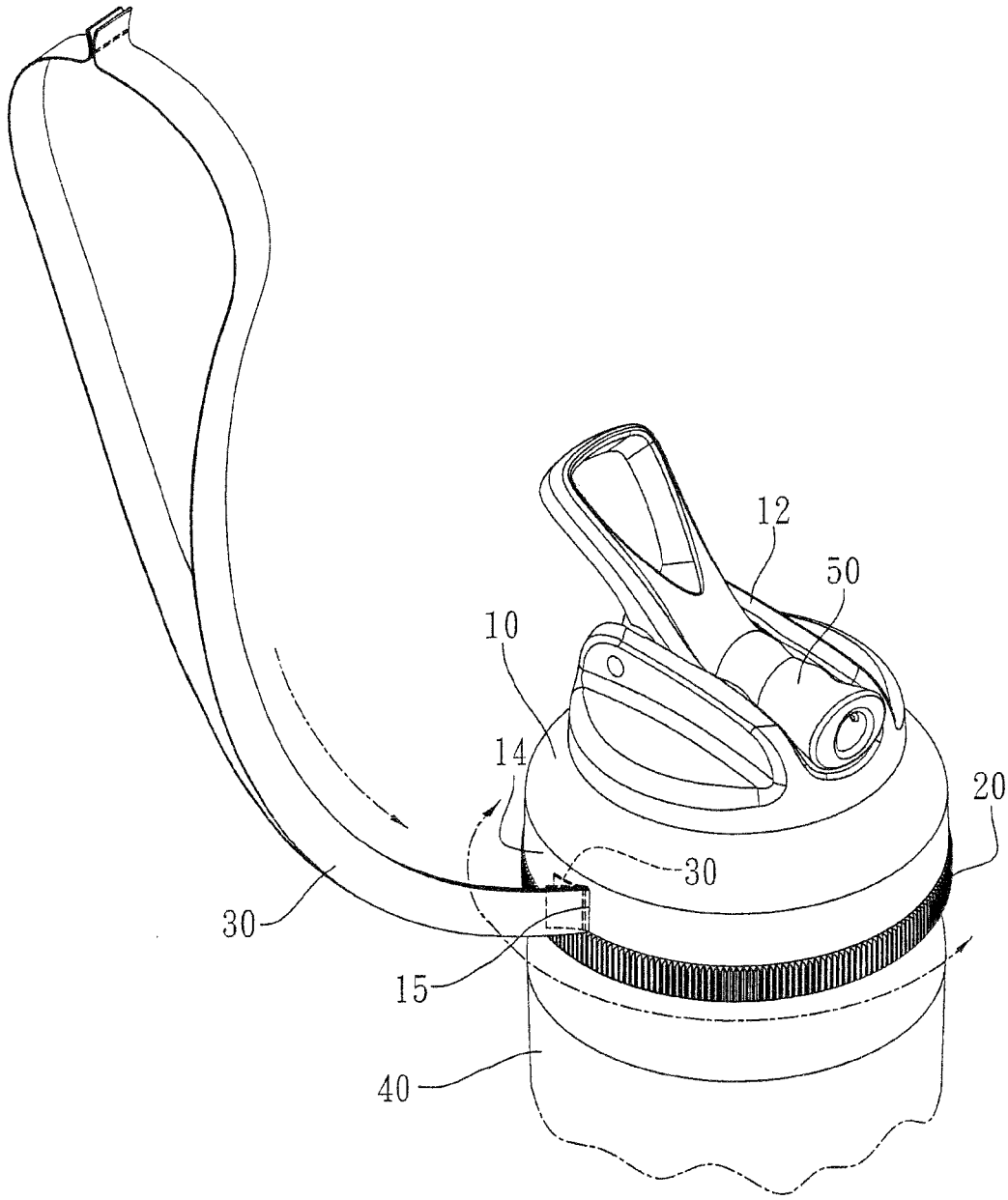
FIG. 4 is a perspective view illustrating retraction and storage of the strap of the present invention the strap.
Figure 5:
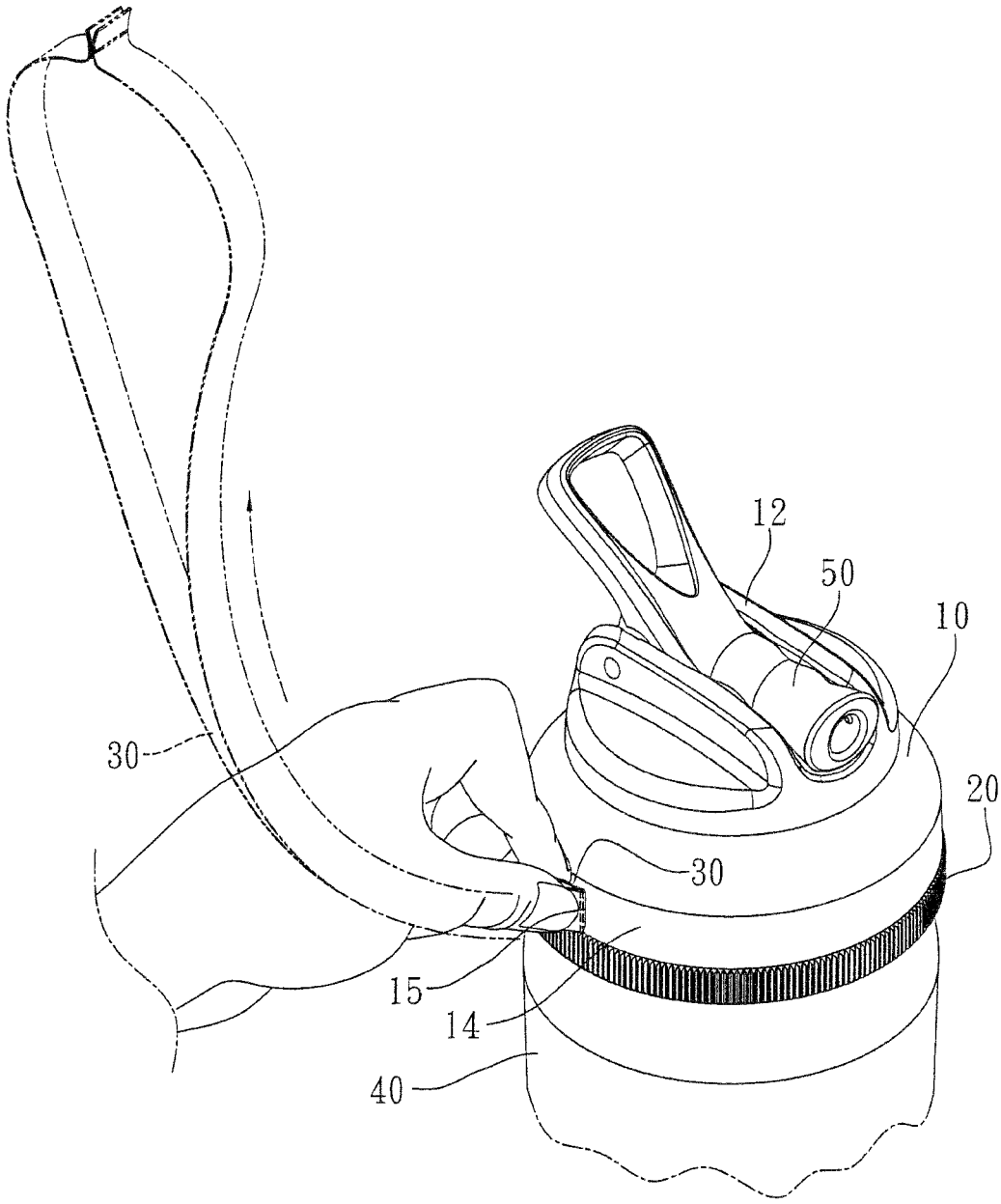
FIG. 5 is a perspective view illustrating extension of the strap of the present invention.

Referring to FIGS. 4 and 5, to use the present invention, a user simply rotates the rotary ring 20 attached to the bottom of the cap 10 to retract and wind backward the strap 30 into the receiving space A inside the cap 10 for being concealed therein. On the other hand, to extend the strap 30 for shoulder carrying, a user simply pull the tips of the end extensions of the strap 30 to fast unwind the concealed strap 30 for being carried on the shoulder of the user.

In summary, the present invention provides the following advantages:

(1) The present invention allows the strap to be fast retracted for being concealed and stored or to be directly pulled off for use, so that the present invention eliminates the drawbacks of inconvenience of repeated mounting and removing a shoulder strap for the conventional water kettles.

(2) The present invention allows the strap to be stowed inside the cap so that the present invention effectively eliminates the potential concern of losing the strap.

(3) The present invention allows a use, in carrying the water kettle, to selectively take shoulder carrying of the water kettle or to simply stow the strap.

Apparently, the present invention actually achieves the desired objective by providing a strap receivable water kettle cap, which realizes the advantage of convenience of use and adaptive applications in different ways of use.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A strap receivable water kettle cap, comprising a cap, a rotary ring, and a strap, characterized in that:

the cap is adapted to couple to a kettle mouth of a water kettle, the cap having a side wall forming an elongate slot, the side wall of the cap having an inside surface forming a coupling structure, the coupling structure coupling the cap and the rotary ring together;

the rotary ring is mounted to a bottom of the cap, the rotary ring having an inside surface forming in a lower edge thereof a coupling seat, the rotary ring forming in an upper portion thereof a vertical wall, the vertical wall forming an extension and retention section; and the strap is receivable in a receiving space defined between the cap and the rotary ring and extends through the extension and retention section of the vertical wall of the rotary ring and further extends through the slot of the side wall of the cap to partially project outward for carrying.

2. The strap receivable water kettle cap according to claim 1, wherein the vertical wall of the rotary ring comprises a diameter reduced circumferential wall, the circumferential wall and the side wall of the cap forming a receiving space.

3. The strap receivable water kettle cap according to claim 1, wherein the rotary ring has an outer circumference forming a roughened section.

4. The strap receivable water kettle cap according to claim 2, wherein the rotary ring has an outer circumference forming a roughened section.

5. The strap receivable water kettle cap according to claim 1, wherein the coupling structure formed on the side wall of the cap comprises a plurality of pawls, the cap using the pawls to engage the rotary ring.

6. The strap receivable water kettle cap according to claim 2, wherein the coupling structure formed on the side wall of the cap comprises a plurality of pawls, the cap using the pawls to engage the rotary ring.

7. The strap receivable water kettle cap according to claim 1, wherein the cap has a bottom rim forming a raised rib, the circumferential wall having a lower end forming a recessed step, the step forming therein a groove that corresponds to the raised rib of the cap, whereby in assembling, the raised rib is fit into and coupled to the groove.

8. The strap receivable water kettle cap according to claim 2, wherein the cap has a bottom rim forming a raised rib, the circumferential wall having a lower end forming a recessed step, the step forming therein a groove that corresponds to the raised rib of the cap, whereby in assembling, the raised rib is fit into and coupled to the groove.

9. The strap receivable water kettle cap according to claim 1, wherein the extension and retention section structurally comprises at least two parallel slits to allow the strap to extend through parallel slits to be retained thereby.

10. The strap receivable water kettle cap according to claim 2, wherein the extension and retention section structurally comprises at least two parallel slits to allow the strap to extend through parallel slits to be retained thereby.

11. The strap receivable water kettle cap according to claim 1, wherein the cap forms therein an internal thread and has a top forming a retention seat to support a suck nozzle, the retention seat having a bottom form a water outlet extending therethrough.

12. The strap receivable water kettle cap according to claim 1, wherein the coupling structure formed on the side wall of the cap comprises a plurality of pawls, between adjacent ones of which a connection wall is formed.

* * * * *